United States Patent [19]

Shacklett, Jr.

[11] Patent Number: 4,660,856

[45] Date of Patent: Apr. 28, 1987

[54] INFORMATION FOLDER CONSTRUCTION

[76] Inventor: James H. Shacklett, Jr., 2025 Joshua Rd., Lafayette Hill, Pa. 19444

[21] Appl. No.: 801,621

[22] Filed: Nov. 25, 1985

Related U.S. Application Data

[63] Continuation-in-part of Ser. No. 650,516, Sep. 14, 1984, Pat. No. 4,583,763, and Ser. No. 103,593, Dec. 14, 1979, abandoned, and Ser. No. 940,073, Aug. 25, 1978, abandoned, and Ser. No. 752,446, Dec. 20, 1976, abandoned.

[51] Int. Cl.[4] ..... B42D 3/18; B42D 19/00; B65D 27/00; B31B 1/26

[52] U.S. Cl. ..... 281/5; 281/1; 229/92.1; 493/405

[58] Field of Search ..... 281/1, 5; 283/1 R, 56, 283/62; 229/92.1, 92.7, 92.8, 70, 73, 69; 493/216, 303, 405, 921

[56] References Cited

U.S. PATENT DOCUMENTS

| | | | |
|---|---|---|---|
| 653,152 | 7/1900 | Roeber | 493/405 |
| 1,016,626 | 2/1912 | Harris | 493/405 |
| 1,076,450 | 10/1913 | Rindsberg | 229/92.7 |
| 2,507,615 | 5/1950 | Sharp, Jr. | 493/405 |
| 3,306,632 | 2/1967 | Stahmer | 229/92.1 |
| 3,941,309 | 3/1976 | Gendron | 229/92.1 |

FOREIGN PATENT DOCUMENTS

| | | | |
|---|---|---|---|
| 400774 | 10/1921 | France | 229/92.1 |

*Primary Examiner*—Paul A. Bell
*Assistant Examiner*—Paul M. Heyrana
*Attorney, Agent, or Firm*—Robert K. Youtie

[57] ABSTRACT

A folder wherein a strip of paper is folded upon itself about a transverse crease line to form elongate overlying leaves of different lengths, the strip being wound with the longer leaf outward to form a spiral of numerous ovaloid convolutions each having its entire outer surface in facing engagement with the inner surface of the next outer convolution, the convolutions having arcuate end portions and side portions extending between the end portions with each end portion in reinforcing abutting engagement with the convolution end portion of the next outer convolution, and the outer leaf end being detachably secured to the nether convolution, for releasably retaining the strip in its spiral configuration.

6 Claims, 5 Drawing Figures

INFORMATION FOLDER CONSTRUCTION

CROSS-REFERENCES TO RELATED APPLICATIONS

This application is a continuation-in-part of application Ser. No. 650,516 filed Sept. 14, 1984, now U.S. Pat. No. 4,583,763; application Ser. No. 103,593 filed Dec. 14, 1979, now abandoned; application Ser. No. 940,073 filed Aug. 25, 1978, now abandoned; and application Ser. No. 752,446 filed Dec. 20, 1976, now abandoned.

BACKGROUND OF THE INVENTION

The information folder of the present invention has been primarily developed and employed in conjunction with the distribution of drugs, being imprinted with information required and desired for use of the drugs. It is appreciated that the present folder construction is capable of many varied applications, all of which are intended to be comprehended herein.

Prior drug information folders have required complex pleating and other folding, which is time consuming and expensive in manufacture of the folders, makes the folders difficult to use in automatic packaging machinery by the necessarily flimsy nature of the folder material, and also such prior folders were relatively bulky and unduly space consuming, even in their fully folded condition.

SUMMARY OF THE INVENTION

It is an important object of the present invention to provide an information folder which overcomes the above-mentioned difficulties, being highly resistant to unintentional unfolding while permitting of quick and easy opening when desired; being fabricated of relatively flimsy paper material but having a staunchness and durability in its folded condition for reliable handling by high speed packaging machinery without jamming, by reason of multiple arcuate paper layers in abutting, mutually reinforcing relation; and which folder construction is adapted for high speed, economical manufacture by the method and apparatus of U.S. Pat. No. 4,136,860 to Shacklett, Jr. et al.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 4:
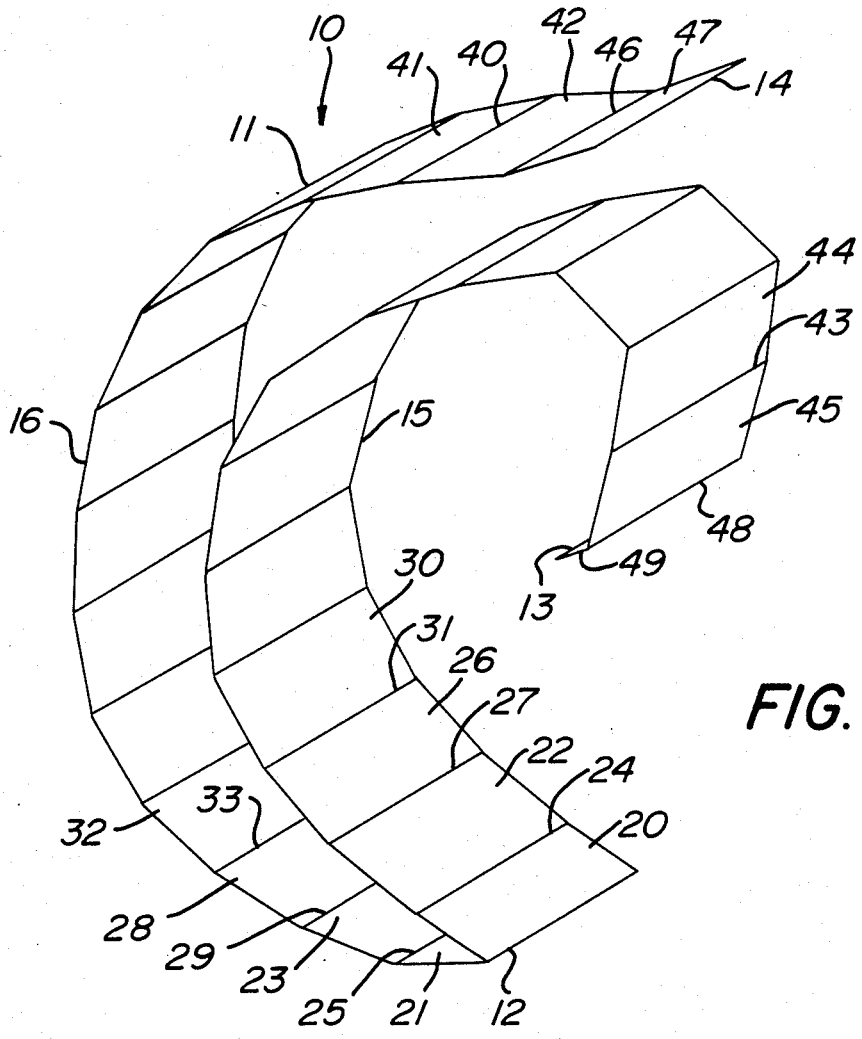
FIG. 4 is a diagrammatic representation of a later stage in the opening of the folder of FIG. 3.

Referring now more particularly to the drawings, and specifically to FIG. 4 thereof, the partially open folder 10 is there seen as fabricated from a single elongate strip 11 of thin bendable and foldable material, such as paper. The strip 11 is folded about a transverse crease 12 extending generally normal to the longitudinal dimension of the strip. The location of the crease or fold line 12 is off the midpoint of the strip 11 so as to be spaced unequally between the strip ends 13 and 14. Thus, the strip 11 folded about the transverse crease 12 may be considered as defining a pair of overlying leaves 15 and 16 of unequal lengths between the crease 12 and respective ends 13 and 14. In particular, the leaf 16 is of greater length than the leaf 15, as will appear more fully hereinafter.

In manufacture of the instant folder, a sheet of strip 11 is folded about crease 12 and rolled about a mandrel from the crease outwardly forming a tubular spiral of circular formation, which tubular spiral is withdrawn endwise from the mandrel and rolled between the bight of a pair of rollers for oblate flattening, all as disclosed in prior U.S. Pat. No. 4,136,860 to Shacklett, Jr. et al.

Figure 5:
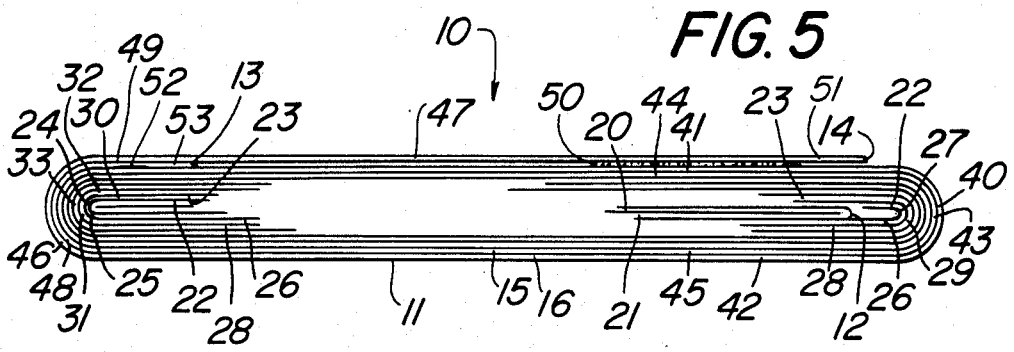
FIG. 5 is an enlarged end view of the unopened folder of FIG. 1.

When the folder 10 is fully wound, as in FIG. 5, the transverse crease 12 lies in a generally central plane of the ovaloid spiral. From the crease 12 there extends, in flat facing engagement with each other a pair of generally planar panels 20 and 21 of the shorter and longer strip leaves 15 and 16, respectively. The leaves 15 and 16, in their laterally coextensive, overlying relation are spirally wound outwardly from the crease 12 and panels 20 and 21 to form a multitude of two-ply ovaloid convolutions, with each convolution having its entire outer surface in facing engagement with the inner surface of the next outer convolution. For example, the innermost panels 20 and 21 extend respectively to adjacent, next innermost panels 22 and 23 and combine therewith to define the innermost convolution. The panels 20 and 22 of leaf 15 are hingedly connected together by a fold line, crease or bend 24, while the panels 21 and 23 are hingedly connected together by a fold line, crease or bend 25. The creases or bends 24 and 25 define the arcuate end portion of the innermost convolution, the inner crease 24 being in total and complete surface engagement with the inner surface of the outer crease or bend 25, so that the creases mutually stiffen and reinforce each other by their mutual abutting engagement.

Similarly, a generally flat panel portion or layer 26 of the inner leaf 15 extends from and is hingedly connected to the panel 22, remote from the panel 20, by the fold line, crease or bend 27; while a generally flat panel or layer 28 is hingedly connected to and extends from the panel 23, remote from the fold 25, by the hinge, crease or bend 29. The creases or bends 27 and 29 are similarly in total and complete facing engagement with each other, defining a two-ply arcuate convolution end portion with the layers in abutting engagement for mutual stiffening and reinforcement.

The inner leaf 15 is further formed of an additional generally flat layer portion or panel 30 extending from the panel 26 remote from the panel 22 and hingedly connected to the panel 26 by a fold line, crease or bend 31. The outer leaf 16 is further formed with a generally flat layer portion or panel 32 which extends from the panel 28 remote from the panel 23, and is hingedly connected to the panel 28 by a crease, fold or bend 33.

In the closed configuration of FIG. 4, the arcuate convolution end portion or bend 27, 29 is respectively connected to the straight or flat convolution side portion or panels 22 and 23 of the innermost convolution, and also to the side portion or panels 26 and 28 of the next outer convolution. The convolution end portion or folds or bends 31, 33 extends from the generally straight or flat convolution side portion or panels 26 and 28, and extends to the convolution side portion or panels 30 and 32.

Thus, the several convolutions of the arcuate spiral of wound strip 11 each include a pair of arcuate end portions and a pair of generally flat or straight side portions extending betweeen the end portions. Of course, the arcuate end portion of one spiral may be considered as the arcuate end portion of the next adjacent spiral, depending upon where a convolution is said to begin.

The convolutions are each of two thicknesses of paper or plies, and may progress outwardly to the leaf ends 13 and 14 with each convolution having its entire outer surface in facing engagement with the inner surface of the next outer convolution, and with the arcuate convolution end portions each being in reinforcing abutting engagement with the convolution end portions of the next outer convolution.

This effects cumulative reinforcement and stiffening of the entire folder for high resistance to deformation and damage in handling by high speed packaging machinery.

The convolutions progress outwardly in the manner described above to an outermost convolution wherein the longer, outer leaf 16 includes an arcuate fold or bend 40 hingedly connecting panels 41 and 42; and the shorter, inner leaf 15 includes an arcuate bend or fold 43 hingedly connecting generally flat side portions or panels 44 and 45.

Thus, the two layer or ply bends 40 and 43 define one arcuate end portion of the outermost convolution, the arcuate end portions being in reinforcing abutting engagement with each other and with the adjacent inner convolution end portions.

The outer side portion or panel 42 extends to an outer arcuate convolution portion or bend 46 which is, in turn, hingedly connected to a terminal outer leaf portion or panel 47. The flat leaf portion or panel 45 of the inner leaf 15 extends to an arcuate convolution end portion or bend 48 in abutting engagement with the next outer end portion or bend 46, and connected to a terminal leaf portion or panel 49. It will be seen that the end edge 13 of the end panel 49 terminates short of and inwardly of the terminal end 14 of the outer end panel 47.

On the inner surface of the outer end panel 47, spaced inwardly from the panel end edge 14, there is applied a releasable adhesive material or glue 50. By this means, the outer terminal panel 47 is effectively secured to the next inwardly adjacent nether panel 41 to effectively retain the entire spiral in its illustrated condition. As the adhesive 50 is spaced inwardly from the leaf end edge 14, there remains proximate to the end edge an unsecured portion or flap 51 providing a finger pull or tab for convenient manual release of the adhesive.

While the adhesive material 50 will serve to retain the folder 10 in its wound condition, there is advantageously provided an additional quantity of releasable adhesive 52 on the inner surface of the panel 49 for detachably securing the latter in its overlying relation with the next inwardly adjacent nether panel 41. The adhesive 52 is spaced inwardly from the terminal edge 13 of the inner leaf 15, so as to define of the terminal portion 53 a free tab for grasping to release the glue 52 from adhesion to the nether layer.

Figure 1:
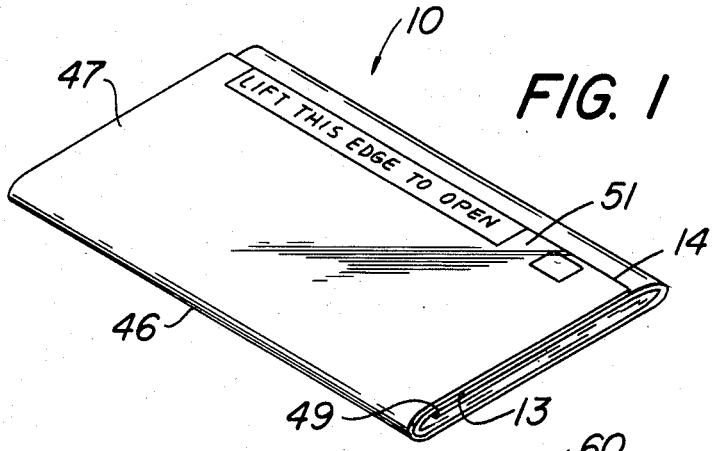
FIG. 1 is a perspective view showing a folder construction of the present invention in its unopened condition.
Figure 3:
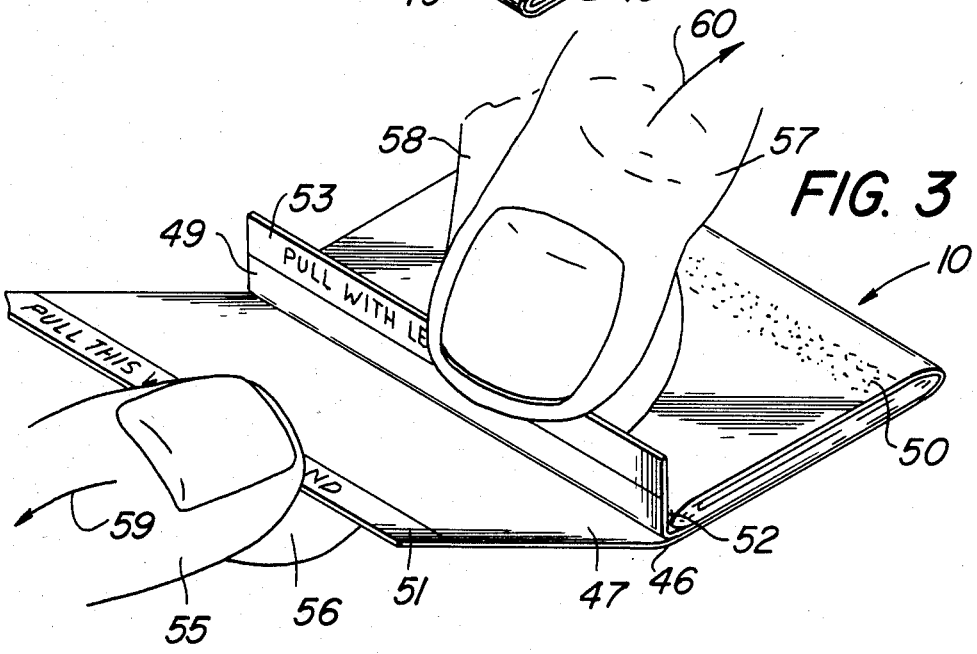
FIG. 3 is a perspective view showing the folder of FIG. 1 being opened.
Figure 2:
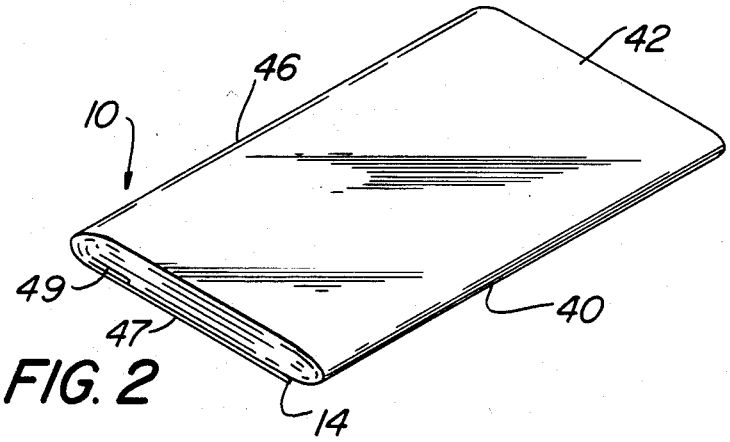
FIG. 2 is a perspective view of the folder of FIG. 1 from the opposite angle.

The opening procedure is illustrated in FIG. 3, thumb and forefinger 55 and 56 being shown grasping the outermost pull tab 51 of terminal panel 47 for releasing the adhesive 50 and freeing the panel from the next adjacent convolution. Further, thumb and forefinger 57 and 58 are shown grasping the pull tab 53 to detach the adhesive 52 from the next inner, adjacent layer; and upon continued manual motion in the directions of arrows 59 and 60, the folder 10 will be opened, passing through the condition shown in FIG. 4 to a fully extended condition, where all of the information is readily accessible to the user.

Although the present invention has been described in some detail by way of illustration and example for purposes of clarity of understanding, it is understood that certain changes and modifications may be made within the spirit of the invention.

What is claimed is:

1. A folder construction comprising an elongate strip of thin flexible paper folded assymetrically about a transverse line to form a crease along said line and a pair of overlying leaves of different lengths extending from said crease and terminating at strip ends spaced different distances from said crease, said strip being wound from said crease outwardly to form a spiral having many ovaloid convolutions with each convolution having its entire outer surface in facing engagement with the inner surface of the next outer convolution, said convolutions each having arcuate end portions and side portions extending between said end portions, said convolution end portions each being in reinforcing abutting engagement with the convolution end portions of the next outer convolution for cumulative stiffening of the outward convolution end portions, said strip ends being detachably secured to the nether convolutions, detachment of the strip ends enabling unwinding of said spiral convolutions, said strip being wound with the longer leaf outwardly to overlie the shorter leaf and its strip end, and releasable adhesive detachably securing the strip end of said outwardly wound longer leaf to the nether convolution, said strip ends both terminating in the outermost convolutions in adjacent relation with respect to each other and overlying the same convolution side portion, whereby detachment of the outer strip end presents immediately therebeneath the inner strip end.

2. A folder construction according to claim 1, said convolution side portions being generally flat and the sides of the innermost convolution being in facing engagement with each other.

3. A folder construction according to claim 1, in combination with a tab on said longer leaf strip end for manual grasping to release said adhesive.

4. A folder construction according to claim 3, said tab being defined by the terminal portion of said longer leaf strip end free of said nether convolution.

5. A folder construction according to claim 1, in combination with additional releasable adhesive detachably securing the strip end of said shorter leaf to the nether convolution of said longer leaf.

6. A folder construction according to claim 5, in combination with a tab on said shorter leaf strip end for manual grasping to release said additional adhesive, said tab being defined by a terminal portion of said shorter leaf strip end free of said nether convolution.

* * * * *